United States Patent [19]

Verini

[11] 4,114,159

[45] Sep. 12, 1978

[54] DUAL PIVOT MOUNT ASSEMBLY FOR AN AUTOMOBILE ANTENNA

[76] Inventor: Anthony J. Verini, 30 Lenox Ave., Green Brook, N.J. 08812

[21] Appl. No.: 737,552

[22] Filed: Nov. 1, 1976

[51] Int. Cl.[2] ..... H01Q 1/32

[52] U.S. Cl. ..... 343/715; 248/539

[58] Field of Search ..... 343/713, 715, 881, 882; 248/539

[56] References Cited

U.S. PATENT DOCUMENTS

| | | | |
|---|---|---|---|
| 3,521,285 | 7/1970 | Mautner | 343/709 |
| 4,028,705 | 6/1977 | Loyd | 343/715 |
| 4,035,806 | 7/1977 | Powell | 343/715 |

FOREIGN PATENT DOCUMENTS

| | | | |
|---|---|---|---|
| 1,200,425 | 6/1959 | France | 343/713 |
| 1,332,513 | 2/1960 | France | 343/715 |

*Primary Examiner*—Eli Lieberman

*Attorney, Agent, or Firm*—Frederick W. Padden

[57] ABSTRACT

Described is a mount assembly comprising a support member pivotally mounted, about a first axis, to a rigid body (e.g., the underside of a motor vehicle trunk lid) and a bracket pivotally mounted, about a second axis, to the support member so as to protrude above and to one side of the rigid body. An object such as a CB radio antenna, is mounted on the bracket. Resilient means couples the bracket to the support member for translation of the bracket along the second axis. The bracket, in addition, includes means for engaging the rigid body when the resilient means is under compression. In one embodiment the support member is mounted on the underside of an auto trunk lid and the engaging means includes a flange which engages a side edge of the lid. In another embodiment, the support is mounted on the underside of a van roof, near a rear or side door, and the engaging means includes a pair of hook-like fingers which engage a rain gutter above the door.

10 Claims, 12 Drawing Figures

DUAL PIVOT MOUNT ASSEMBLY FOR AN AUTOMOBILE ANTENNA

BACKGROUND OF THE INVENTION

This invention relates to foldable mounts and, more particularly, to a storable mount assembly for communication band (CB) antennas and the like for use with radio transmitter-receiver equipment in motor vehicles.

The boom in popularity of CB radio equipment for motor vehicles on the one hand is evident from even a cursory count of the number of CB antennas protruding from the trunks and roofs of automobiles, vans and other vehicles, and on the other hand is confirmed by the flood of CB manufacturers advertising their wares in all forms of media. Literally, millions of CB radios and similar equipment have been installed in private automobiles alone. Unfortunately, this popularity has been followed by an alarming increase in the number of thefts and vandalism involving CB radios and accessories. Indeed, the situation has become so serious that standard automobile insurance policies have been amended to exclude coverage of CB equipment without payment of costly additional premiums ranging typically from 20 to 200 dollars.

One way suggested in the prior art to reduce theft and vandalism of CB radio equipment is to conceal the antenna when the automobile is left unattended. Typical of prior art solutions is the "foldable" antenna mount which is simply a step-like bracket hinged to the trunk rain channel. However, when folded down for storage, the antenna protrudes into the trunk space thereby interfering with the storage space of the trunk. In addition, an antenna left in the stored position while the vehicle is in motion could be damaged if objects in the trunk accidentally bounce or slide against it. Another disadvantage of foldable-type mounts is that they are generally unsuitable for vehicles without trunk lids, for example, vans and buses.

It is, therefore, a broad object of my invention to provide a mount assembly for radio antennas.

It is another object of my invention to provide a mount assembly for CB radio antennas on motor vehicles.

It is still another object of my invention to provide such an assembly which is suitable for use on vehicles having trunk lids as well as those which do not.

It is yet another object of my invention to provide a mount assembly for CB radio antennas which permits the antenna to be stored without interfering with trunk space.

SUMMARY OF THE INVENTION

These and other objects are accomplished in accordance with one embodiment of my invention, a dual pivot mount assembly comprising a support member pivotally mounted about a first axis to a rigid body and a bracket pivotally mounted about a second axis to the support member so as to protrude above and to one side of a rigid body. An object, such as an antenna, is mounted on the bracket. Resilient means couples the bracket to the support member for translation of the bracket along the second axis. The bracket includes means cooperating with the resilient means for engaging the rigid body.

In an illustrative embodiment of my invention, a dual pivot mount assembly comprises a rod-like support member pivotally mounted about a first axis to a rigid body and a stepped bracket pivotally mounted to the support member about a second axis orthogonal to the first axis. The bracket includes an upper and lower tread and an upper and lower riser. Spring-loaded means couples the bracket to the support member for translation of the bracket along the second axis. The spring-loaded means includes a rod which is rigidly secured to the lower riser of the bracket, but is slideably and rotateably positioned through a hole in the rod-like support member. A spring, which coaxially surrounds a portion of the rod, is interposed between the other end of the rod and the support member. The bracket includes a flange on the upper riser which, in conjunction with the adjacent, lower tread, engages the rigid body when the spring is compressed.

In operation, the bracket is translated along the second axis in a direction away from the support member, thereby compressing the spring and disengaging the flange and riser from the rigid body. The bracket is then rotated about the second axis (i.e., the rod) until it is below but still to one side of the rigid body. Then, the bracket is rotated about the first axis (i.e., the support member) until it is beneath the rigid body.

In a specific exemplary embodiment of my invention, the above embodiment is adapted for storeably mounting CB radio antennas on automobiles. The rod-like support member is mounted on the underside of the trunk lid and the antenna is mounted on the upper tread of the bracket. When the antenna is in its normal position ready for use, the lower tread and the flange engage the edge of the auto trunk lid so that the antenna is oriented vertically above and slightly to the side of the edge of the trunk lid. When stored, the bracket is rotated as described above so as to position the antenna against the underside of the trunk lid. In this position, the antenna does not interfere with trunk storage space and is safer from damage by sliding or bouncing objects in the trunk.

In a second specific exemplary embodiment, my mount assembly is adapted for use in mounting CB antennas on motor vehicles such as vans which do not have a trunk lid. In this case, the support member is pivotally mounted on the underside of the van roof, typically a rear door, and the engaging means includes a pair of hook-like fingers which, in cooperation with a tread of the bracket, engages a rain gutter above the door.

BRIEF DESCRIPTION OF THE DRAWING

My invention, together with its various features and advantages, can be readily understood from the following more detailed description taken in conjunction with the accompanying drawing, in which.

DETAILED DESCRIPTION

Figure 2:
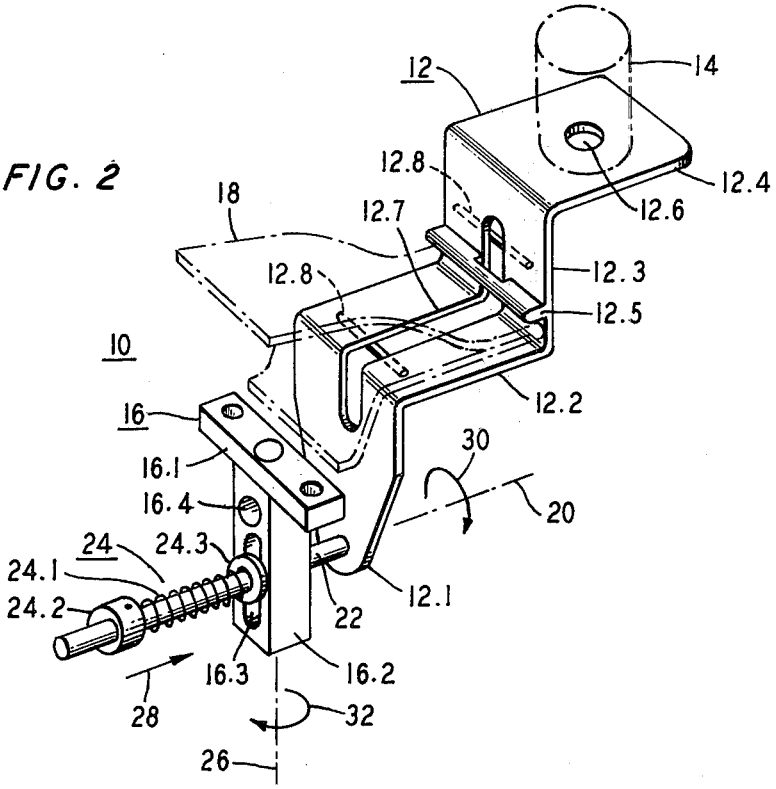
FIG. 2 is a pictorial view of a dual pivot mount assembly in accordance with one embodiment of my invention for use as in FIG. 1.

With reference now to FIG. 2, there is shown a dual pivot mount assembly 10 for mounting an object 14 above and slightly to the side of a rigid body 18 shown in phantom. Typically, body 18 is a wall or lid portion of a storage compartment. Assembly 10 comprises a support member 16 pivotally mounted about a first axis 26 to rigid body 18 and a bracket 12 pivotally mounted about a second axis 20 to the support member 16 so as to protrude above and to the side of the edge of rigid body 18. Resilient means 24 couples the bracket 12 to support member 16 for translation of bracket 12 along second axis 20. In addition, bracket 12 includes means 12.1–12.5 cooperating with resilient means 24 for engaging an edge of rigid body 18.

In FIG. 2 the bracket 12 is shown in its normal position; that is, ready for use object 14 which might be an antenna or searchlight, for example.

In order to store the object 14, bracket 12 is first translated along axis 20 in the direction of arrow 28, that is, against the urging of resilient means 24, thereby disengaging means 12.2–12.3 from the edge of rigid body 18. Next, bracket 12 is rotated about first axis 20 so that it no longer protrudes above rigid body 18. Then, the bracket 12 is rotated about second axis 26 (i.e., about support member 16) so that it lies in its stored position along the underside of rigid body 18.

Figure 1:
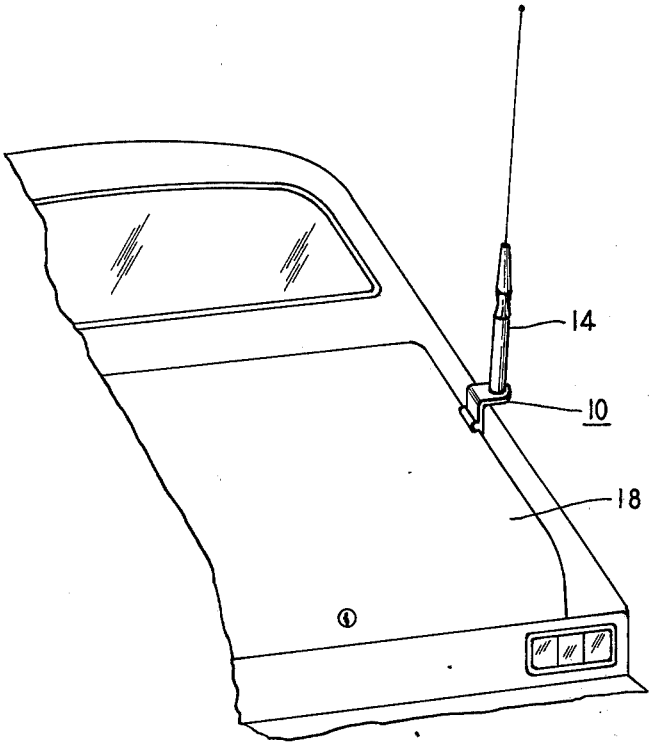
FIG. 1 depicts a CB antenna mounted on dual pivot mount assembly which in turn is mounted on the underside of an automobile trunk lid.

In an illustrative embodiment of my dual pivot mount assembly 10 object 14 to be mounted is an antenna (e.g., a CB radio antenna) and rigid body 18 is the trunk lid of an automobile as shown in FIG. 1. This embodiment will now be described with more specificity by reference to FIGS. 3–7. In particular, support member 16 is pivotally mounted on the underside of trunk lid 18 by means of a base member 16.1 rigidly secured to lid 18. A rectangular rod 16.2 is pivotally connected to base member 16.1 and is rotateable about first axis 26. Bracket 12, on the other hand, has a stepped configuration comprising lower and upper risers 12.1 and 12.3 joined together by a lower tread 12.2. Upper tread 12.4 is connected to upper riser 12.3 and has a hole 12.6 used for mounting antenna 14. Bracket 12 is pivotally mounted about a second axis 20 to support member 16; that is, cylindrical rod 22 is rigidly secured to lower riser 12.1 and extends through an elongated aperture 16.3 which itself extends transversely through rectangular rod 16.2. Spring-loaded resilient means 24 couples bracket 12 for translation along axis 20; that is, a spring 24.1 is coaxially disposed around a portion of rod 22 on the side of support member 16 remote from bracket 12. Spring 24.1 is retained between a collar 24.2 rigidly secured to rod 22 and a washer 24.3 loosely disposed around rod 22. In addition, bracket 12 includes means 12.2–12.5 cooperating with spring-loaded means 24 for engaging an edge of trunk lid 18; that is, in the normal position the edge of lid 18 is disposed under a flange 12.5 on upper riser 12.3 and flush with lower tread 12.2. Since spring 24.1 is under compression an inward spring force keeps the flange and riser engaged to the trunk lid.

Figure 3:
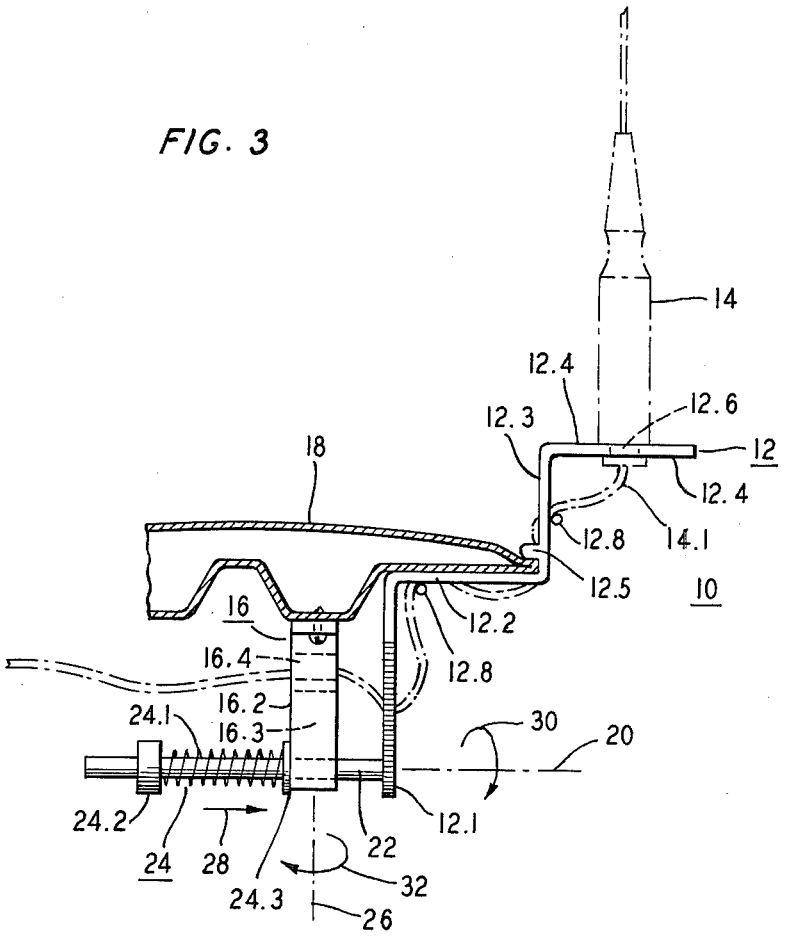
FIG. 3 shows how the assembly of FIG. 2 is mounted on the underside of a trunk lid so that the antenna is positioned for operation.
Figure 4:
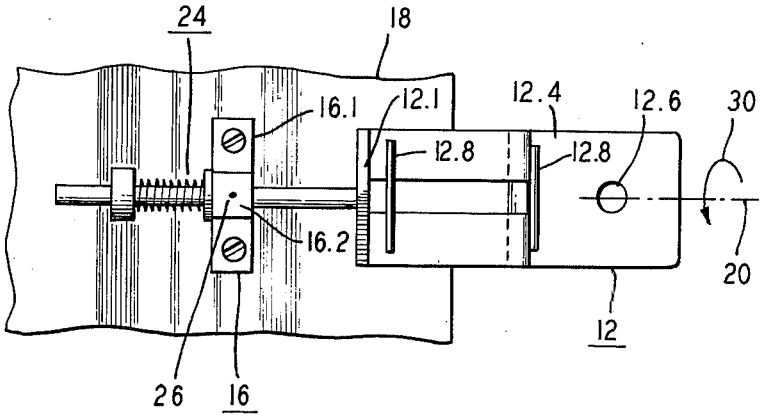
FIGS. 4, 5, 6, and 7 show how the assembly of FIGS. 2 and 3 is rotated into the storage position depicted in FIG. 7.
Figure 5:
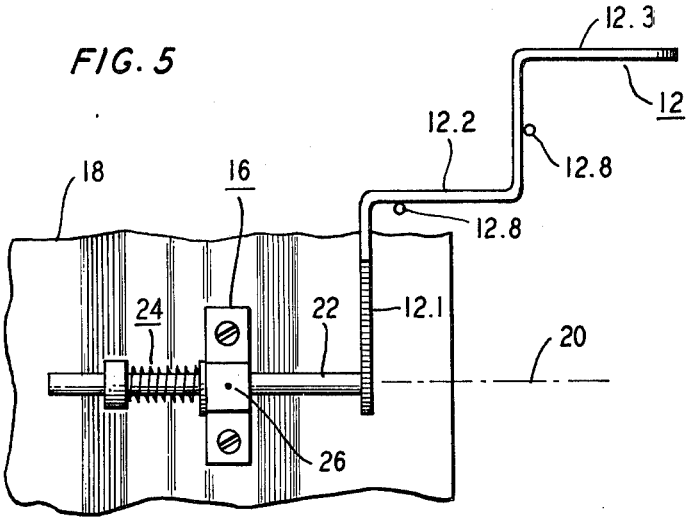
Figure 6:
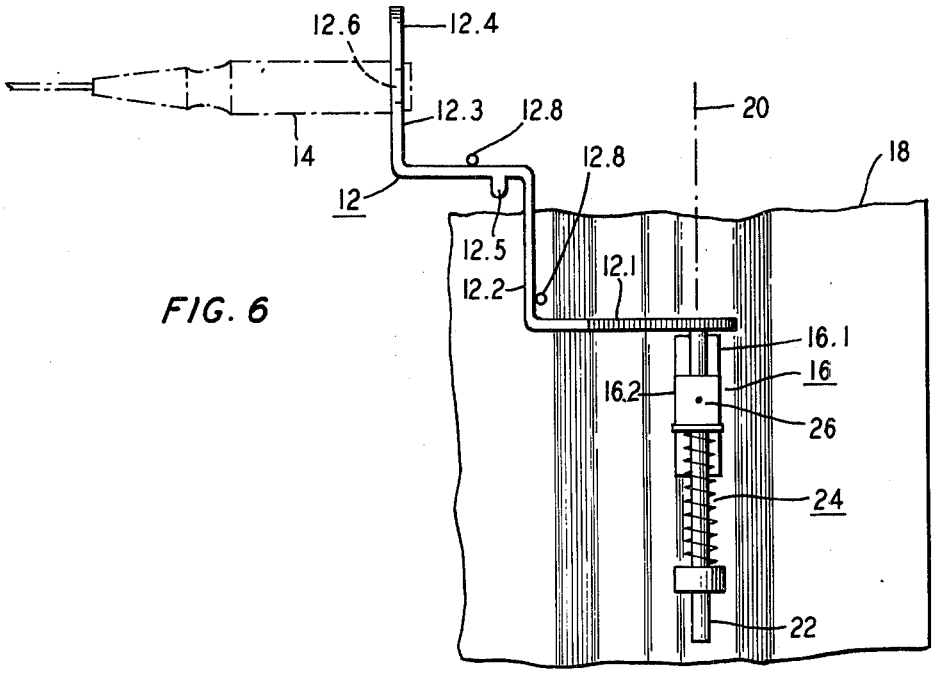
Figure 7:
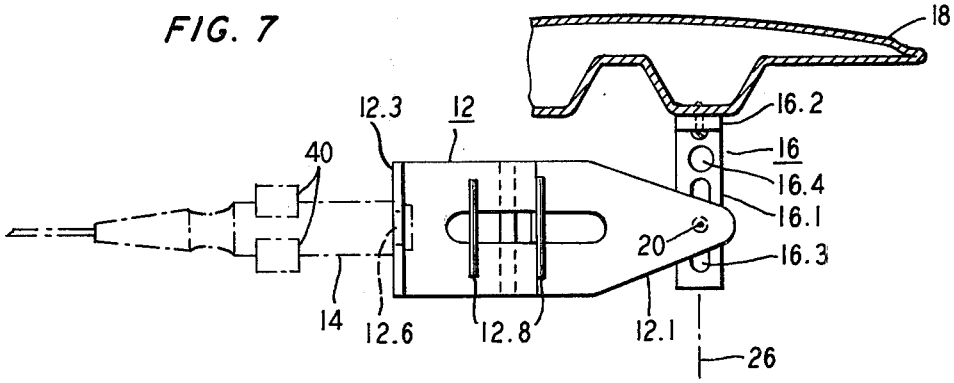

In addition, bracket 12 has an elongated aperture 12.7 centrally disposed in the treads and risers. It extends along the entire length of lower tread 12.2 but only partially along the length of lower and upper risers 12.1 and 12.3 as seen in FIG. 2. Thin rods 12.8 and 12.9 are welded or otherwise secured across the aperture 12.7 on both upper riser 12.3 and lower tread 12.2. As shown in FIG. 3, the aperture 12.7 in conjunction with rods 12.8 and 12.9 allow the antenna cable 14.1 to be snaked through the bracket 12 so that it doesn't dangle and interfere with pivoting of the assembly 10. Further toward this end, support member 16 has a circular aperture 16.4 above elongated aperture 16.3 as seen in FIG. 2. Cable 14.1 also is passed through aperture 16.4 and thence through the automobile to its transceiver.

The normal position of assembly 10 is shown in FIG. 3. Bracket 12 engages trunk lid 18 and antenna 14 protrudes vertically upward above the edge of the lid as shown in FIG. 1. In this position, the antenna is ready for use with the transceiver. In order to store the antenna, however, the trunk lid is opened (FIG. 4) and bracket 12 is translated outwardly along axis 20 in the direction of arrow 28. This action further compresses spring 24.1 but permits bracket 12 to rotate on cylindrical rod 22 about first axis 20. Typically, bracket 12 is rotated through an angle of about 90 ° until it is in the position shown in FIG. 5. Next bracket 12 is rotated on rectangular rod 16.1 about second axis 26 typically through angle of 90° to the position shown in FIG. 6 (view facing open trunk lid 18) and FIG. 7 (view facing end of lid 18). Finally, the bracket is retained in this stored position by means of spring clip 40 which is affixed to the underside of lid 18.

When so stored, the antenna 14 is secured to the underside of lid 18 and thus does not protrude into the storage space of the trunk. Thus, it is also safer from damage as described previously and, of course, is hidden from view, thereby providing a measure of protection against theft and vandalism to both the antenna and the transceiver.

Figure 8:
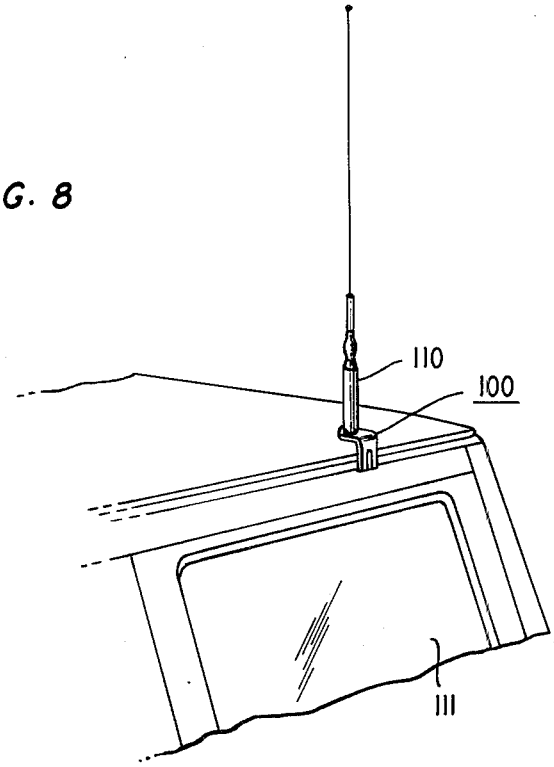
FIG. 8 depicts a CB antenna mounted on a dual pivot mount assembly which in turn is mounted on the underside of a van roof.
Figure 9:
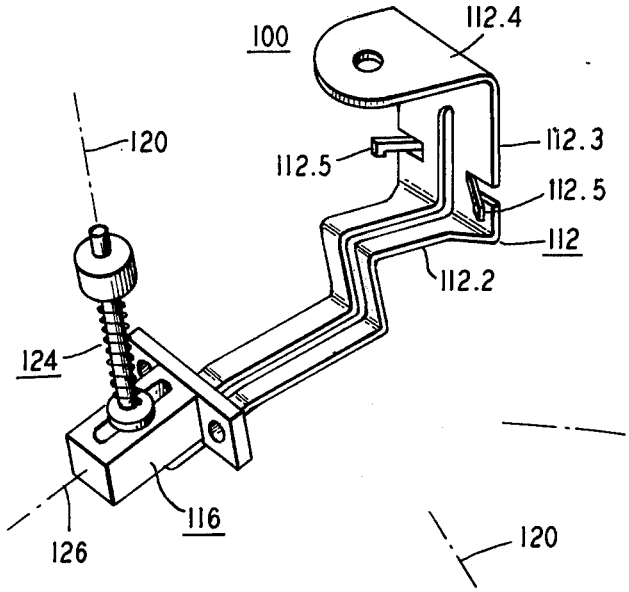
FIG. 9 is a pictorial view of a dual pivot mount assembly in accordance with another embodiment of my invention for use as in FIG. 8.
Figure 10:
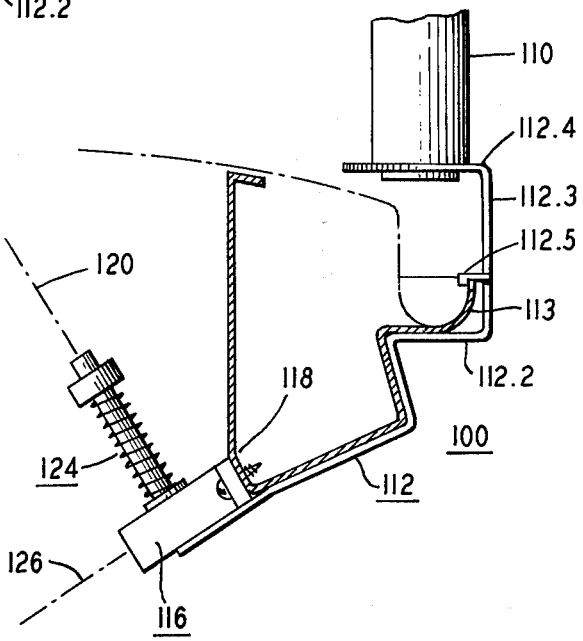
FIGS. 10, 11, and 12 show how the assembly of FIG. 9 is rotated into the storage position depicted in FIG. 12.
Figure 11:
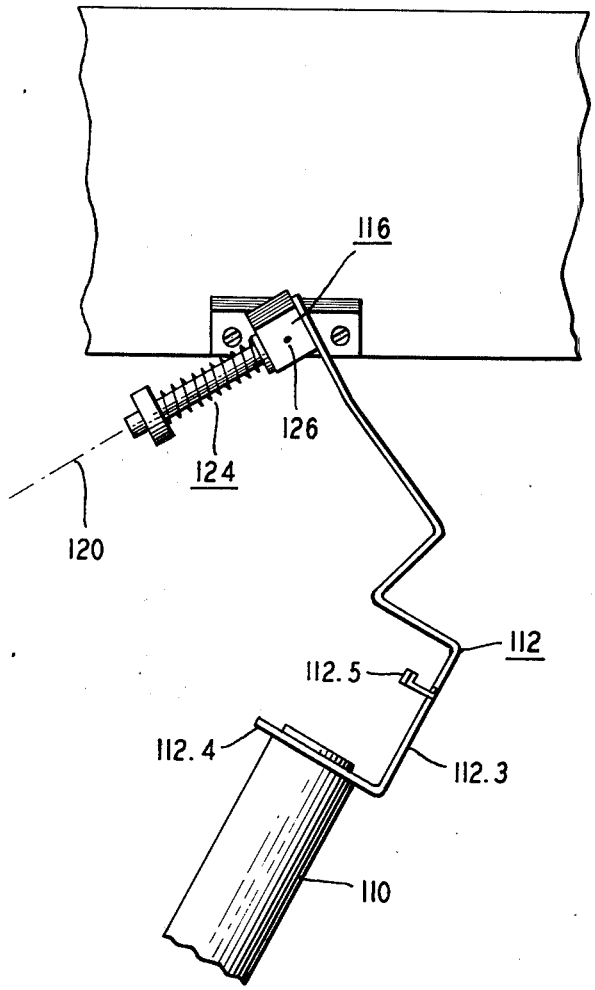
Figure 12:
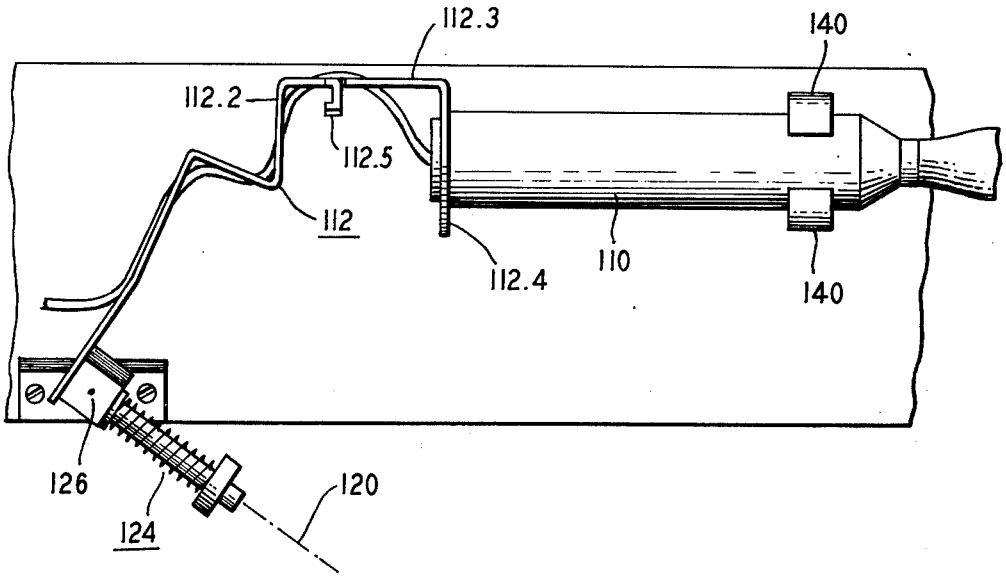

It is to be understood that the above-described arrangements are merely illustrative of the many possible specific embodiments which can be devised to represent application of the principles of my invention. Numerous and varied other arrangements can be devised in accordance with these principles by those skilled in the art without departing from the spirit and scope of the invention. In particular, my invention can be adapted for use on motor vehicles such as vans which do not have trunk lids. Thus, another embodiment of my dual pivot mount assembly for CB antennas and the like is shown in FIGS. 8–12. Inasmuch as the general structure and operation of this embodiment are substantially identical to those of assembly 10 of FIGS. 1–7, only the differences will be emphasized herein where appropriate and for convenience of cross reference, the reference numerals of FIGS. 1–7 have been retained but increased by 100. In FIG. 8 the assembly 100 is shown supporting an antenna 110 above the rear door 111 of a van or similar motor vehicle. The details of the assembly 100 are shown in FIGS. 9 and 10. As before, it comprises a support member 116 pivotally mounted about a first axis 126 to a rigid body (i.e., an interior wall or roof portion 118 of the van) and a stepped bracket 112 pivotally mounted about a second axis 120 to support member 116 so as to protrude above the side door 111, particularly above rain gutter 113. To this end, the bracket risers and treads are shaped to conform with the configuration of the auto body and gutter 113 as shown, and (in contrast to assembly 10) the upper tread 112.4 is turned inwardly toward the interior of the van so as to place the antenna 110 above gutter 113. This orientation is optional, however. Tread 112.4 could just as well be oriented outwardly. In further contrast to assembly 10, flange 12.5 has been replaced by a pair of hook-like fingers 112.5 which protrude from upper riser 112.3 and engage the rain gutter 113. Fingers 112.5 in conjunction with tread 112.2 form engaging means of bracket 112 which, in cooperation with spring-loaded means 124, retains the assembly 100 in its normal position shown in FIG. 10.

In order to store the antenna within the van, the operation is nearly identical to that used with assembly 10; that is, bracket 112 is translated along first axis 120 so as to disengage fingers 112.5 from rain gutter 113. Then bracket 112 is rotated about first axis 120 through an angle of typically 90°. Next, bracket 112 is rotated about second axis 126 as in FIG. 11 until it reaches a retainer such as spring clip 140 on an interior wall of the van. The antenna 110 is engaged by clip 140 and is thereby stored until ready use.

It is to be understood that the foregoing is only illustrative of the principles of my invention. In light of my teaching, those skilled in the art can devise other embodiments without departing from the spirit and scope of my invention. For example, it is within my inventive teaching to have the bracket 12 constructed with arcuate rather than right angle segments between means 12.1 through 12.2. Moreover, my teaching includes the provision of a rubber coating on the bracket 12 about, for example, its means 12.5 for reducing the probability of scratching paint on an object such as a trunk lid.

What is claimed is:

1. An assembly for mounting an antenna adjacent to the periphery of an opening in an automobile body comprising:

a support member pivotally mounted about a first axis to said body;

a support rod pivotally mounted to said support member about a second axis;

a bracket for carrying said antenna fixed to one end of said support rod;

resilient means between said support member and the other end of said support rod for biasing said bracket toward said support member;

said bracket including means cooperating with said resilient means for engaging said body; and said bracket being disengageable from said body and rotatable about said first and second axis to a position within said opening.

2. The assembly of claim 1 wherein:

said bracket has a stepped configuration including a plurality of treads and risers interconnected to one another.

3. The assembly of claim 2 wherein:

said engaging means includes one of said treads and a flange protruding from an upper adjacent riser; said side of said body being insertable between said flange and said one tread in said first position.

4. The assembly of claim 2 wherein:

said engaging means includes one of said treads and a plurality of hook-like fingers protruding from an upper adjacent riser, said side of said body being insertable between said fingers and said one tread so that said fingers hook thereon in said first position.

5. The assembly of claim 2 wherein:

said support member includes a first rod rotateably mounted about said first axis to the underside of said body, said rod having an elongated first aperture extending transversely therethrough, and said support rod having one end rigidly secured to said bracket and extending along said second axis through said first aperture, and said resilient means includes spring means positioned between the other end of said support rod and said first rod.

6. The assembly of claim 5 wherein:

said spring means includes a collar secured to said other end of said support rod, a washer loosely positioned on said support rod between said collar and said first rod, and a spring coaxially positioned around said support rod and between said collar and said washer.

7. The assembly of claim 2 wherein:

said bracket has an elongated second aperture which extends along a plurality of said treads and risers and includes a plurality of thin rods rigidly secured across said second aperture in spaced relation to one another.

8. The assembly of claim 2 wherein:

said stepped configuration of treads and risers includes a portion shaped to conform substantially to a portion of the side of said body engaged by said engaging means.

9. An assembly for alternately mounting an antenna and its cable in a first position above and to the side of the edge of a motor vehicle trunk lid and in a second position underneath said lid, comprising:

a support member pivotally mounted about a first axis to the underside of said trunk lid, said member including a first rod having a first elongated aperture extending transversely therethrough, a stepped bracket, including a plurality of treads and risers, being pivotally mounted about a second axis to said support member so as to protrude above and to the side of said lid in said first position, one of said treads being adapted to carry said antenna, said bracket having an elongated second aperture extending along a plurality of said treads and risers and including a plurality of thin rods rigidly secured across said second aperture so that the cable of said antenna can be positioned along said second aperture alternately above and below said thin rods, and spring-loaded means coupling said bracket to said support member for translation of said bracket along said first axis comprising a second rod having one end rigidly secured to one of said risers and extending along said second axis through said first aperture, and spring means positioned between the other end of said second rod and said first rod, said bracket including means cooperating with said spring-loaded means for engaging said edge of said trunk lid in said first position comprising one of said treads and a flange protruding from an upper adjacent riser, said edge being insertable between said flange and said one tread in said first position.

10. An assembly for alternately mounting an antenna and its cable in a first position above the rain gutter along the roof of a motor vehicle and in a second position underneath said roof, comprising:

a support member pivotally mounted about a first axis to the underside of said roof, said member including a first rod having a first elongated aperture extending transversely therethrough, a stepped bracket, including a plurality of treads and risers, being pivotally mounted about a second axis to said support member so as to protrude above said gutter in said first position, one of said treads being adapted to carry said antenna, said bracket having an elongated second aperture extending along a plurality of said treads and risers and including a plurality of thin rods rigidly secured across said second aperture so that the cable of said antenna can be positioned along said second aperture alternately above and below said thin rods, and spring-loaded means coupling said bracket to said support member for translation of said bracket along said first axis comprising a second rod having one end rigidly secured to said bracket and extending along said second axis through said first aperture, and spring means positioned between the other end of said second rod and said first rod, said bracket including means cooperating with said spring-loaded means for engaging said gutter in said first position comprising one of said treads and a plurality of hook-like fingers protruding from an upper adjacent riser, said gutter being insertable between said fingers and said one tread in said first position so that said fingers hook onto an edge of said gutter, and said engaging means having an adherent coating including rubber cooperating with said gutter means.

* * * * *